US005873740A

United States Patent [19]

Alcoe et al.

[11] Patent Number: 5,873,740

[45] Date of Patent: Feb. 23, 1999

[54] ELECTRICAL CONNECTOR SYSTEM WITH MEMBER HAVING LAYERS OF DIFFERENT DUROMETER ELASTOMERIC MATERIALS

[75] Inventors: David J. Alcoe, Vestal; William L. Brodsky, Binghamton; David V. Caletka, Apalachin, all of N.Y.

[73] Assignee: International Business Machines Corporation, Armonk, N.Y.

[21] Appl. No.: 4,681

[22] Filed: Jan. 7, 1998

[51] Int. Cl.[6] ..... H01R 9/09

[52] U.S. Cl. ..... 439/67; 439/493

[58] Field of Search ..... 439/67, 66, 493

[56] References Cited

U.S. PATENT DOCUMENTS

| | | | |
|---|---|---|---|
| 3,861,135 | 1/1975 | Seeger, Jr. et al. | 368/88 |
| 3,883,213 | 5/1975 | Glaister | 439/66 |
| 3,971,610 | 7/1976 | Buchoff et al. | 439/75 |
| 4,184,729 | 1/1980 | Parks et al. | 439/66 |
| 4,575,166 | 3/1986 | Kasdagly et al. | 439/65 |
| 4,577,918 | 3/1986 | Kasdagly | 439/66 |
| 4,902,234 | 2/1990 | Brodsky et al. | 439/67 |
| 4,927,368 | 5/1990 | Shino | 439/66 |
| 5,033,675 | 7/1991 | Shino | 439/66 |
| 5,059,129 | 10/1991 | Brodsky et al. | 439/67 |
| 5,099,393 | 3/1992 | Bentlage et al. | 361/413 |
| 5,142,449 | 8/1992 | Littlebury et al. | 361/782 |
| 5,163,834 | 11/1992 | Chapin et al. | 439/66 |
| 5,338,208 | 8/1994 | Bross et al. | 439/66 |
| 5,599,193 | 2/1997 | Crotzer | 439/66 |

OTHER PUBLICATIONS

IBM Technical Disclosure Bulletin vol. 25, No. 7A, Dec. 82, pp. 3438–3441.

IBM Technical Disclosure Bulletin vol. 12, No. 12, May 1970, p. 2313.

IBM Technical Disclosure Bulletin vol. 18, No. 2, Jul. 1975, p. 340.

IBM Technical Disclosure Bulletin vol. 22, No. 2, Jul. 1979, pp. 444–445.

*Primary Examiner*—Steven L. Stephan
*Assistant Examiner*—T. C. Patel
*Attorney, Agent, or Firm*—Lawrence R. Fraley

[57] ABSTRACT

An electrical connector assembly which utilizes a double layered elastomeric for a pressure exertion member wherein the two, individual layers are of different hardness. The first layer is of a relatively low durometer elastomeric material while the second layer is of higher durometer elastomeric material and includes several projections, e.g., for engaging a circuitized substrate such as a flexible circuit. Both layers preferably have the same spring rate, while the projections of the second layer may possess a variety of different configurations, e.g., cylindrical or boxlike. The individual projections may each include extension portions which in turn are positioned within corresponding openings within the substantially solid first layer.

30 Claims, 6 Drawing Sheets

ELECTRICAL CONNECTOR SYSTEM WITH MEMBER HAVING LAYERS OF DIFFERENT DUROMETER ELASTOMERIC MATERIALS

TECHNICAL FIELD

This invention relates to electrical assemblies and particularly to such assemblies wherein at least two circuitized structures are electrically connected. More particularly, this invention relates to such assemblies wherein external pressure is applied to one or both of the structures (e.g., printed circuit, flexible circuit) with an elastomeric member to effect the connection. Even more particularly, the invention relates to such assemblies that can be used as part of an information handling system (computer).

BACKGROUND OF THE INVENTION

The use of electrical connector assemblies for the purpose of electrically coupling various circuit devices is, of course, well known, with several examples being shown and described in the following patents and publications, the disclosures of which are incorporated herein by reference:

U.S. Patents:

U.S. Pat. No. 3,861,135—R. E. Seeger, Jr. et al
U.S. Pat. No. 3,883,213—F. J. Glaister
U.S. Pat. No. 3,971,610—L. S. Buchoff et al
U.S. Pat. No. 4,184,729—H. L. Parks et al
U.S. Pat. No. 4,575,166—D. G. Kasdagly et al
U.S. Pat. No. 4,577,918—D. G. Kasdagly
U.S. Pat. No. 4,902,234—W. L. Brodsky et al
U.S. Pat. No. 4,927,368—K. Shino
U.S. Pat. No. 5,033,675—K. Shino
U.S. Pat. No. 5,059,129—W. L. Brodsky et al
U.S. Pat. No. 5,099,393—J. R. Bentlage, et al
U.S. Pat. No. 5,142,449—H. W. Littlebury et al
U.S. Pat. No. 5,163,834—F. W. Chapin et al
U.S. Pat. No. 5,338,208—A. Bross et al IBM Technical Disclosure Bulletins:

Vol. 12, No. 12(5/70) p. 2313
Vol. 18, No. 2(7/75) p. 340
Vol. 22, No. 2(7/79) pp. 444–445
Vol. 25, No. 7A(12/82) pp. 3438–3441

Electrical connector assemblies wherein direct contact is desired between the individual electrical conductors (e.g., printed circuit lines, contact pins, etc.) which constitute part of the circuit devices being coupled, as in the case of the instant invention, mandate the application of a reliable contact pressure of sufficient duration and capable of withstanding possible adverse environmental conditions (e.g., heat, moisture). Excessive pressure can result in damage to various components of the assembly (particularly the conductors) during both assembly and/or operation. Additionally, the provision of such pressure has heretofore often been accomplished through the utilization of relatively large components (e.g., connector housings) needed to produce these assemblies, thus also adding unnecessarily to the cost thereof In those assemblies subjected to adverse environmental conditions, failure to withstand same has resulted in such problems as contact corrosion, reduced contact pressure, increased maintenance costs, etc.

U.S. Pat. No. 4,902,234, assigned to the same assignee as the instant invention, defines a connector assembly wherein an elastomeric pressure exertion member is utilized to provide reliable contact pressure against at least one of the circuit members (e.g., a flexible circuit). This exertion member includes a base plate, a plurality of individual compressible elements located on one side of the plate, and a resilient member located on the plate's other side.

U.S. Pat. Nos. 5,059,129 and 5,099,393, both also assigned to the same assignee as the present invention, define electrical connector assemblies for coupling various circuitized substrates such as printed circuit boards wherein elastomeric pressure exertion members are utilized. In both, a stepped, two-layered elastomeric is defined wherein the base (or first) layer includes spaced apertures therein and the upper (or second) layer includes several upstanding projections all of which are strategically located in a specific pattern such that each is oriented adjacent one or more respective apertures. See, e.g., FIG. 6, in U.S. Pat. No. 5,059,129 and FIGS. 10 and 11 in U.S. Pat. No. 5,099,393. The working relationship between such projections, base layer apertures and the respective substrates being engaged to effect electrical coupling is seen in the earlier figures in these patents (e.g., FIG. 3 in U.S. Pat. No. 5,059,129). Significantly, the dual layered (called bilayered in these two patents) elastomeric members in U.S. Pat. Nos. 4,902,234, 5,059,129 and 5,099,393 are typically shown and described as being of one integral unit of the same elastomeric material throughout. (See e.g., col. 7, lines 2–6 of U.S. Pat. No. 4,902,234, col. 5, lines 60–63 of U.S. Pat. No. 5,059,129, and col. 8, lines 43–46 of U.S. Pat. No. 5,099,393). U.S. Pat. Nos. 4,902,234, 5,059,129 and 5,099,393 are incorporated herein by reference.

The formation of elastomeric members as taught in the immediately foregoing two patents, while producing very acceptable exertion force structures, often requires the utilization of relatively complicated mold assemblies to assure proper aperture location in the base layers and precise adjacent placement of the respective upstanding projections for the resulting integral structure. A relatively complicated mold assembly is also understandably needed to produce the elastomeric-metal plate structure defined in U.S. Pat. No. 4,902,234.

It is believed that an electrical connector assembly embodying a pressure exertion member which is comprised of two individual layers each of a different hardness material and which can be manufactured using relatively less complicated mold apparatus and procedures than those known before (particularly in the three patents cited immediately above) would constitute a significant advancement in the art.

DISCLOSURE OF THE INVENTION

It is, therefore, a primary object of the invention to enhance the art of electrical connector assemblies and particularly those using pressure exertion members of the elastomeric variety.

It is a more particular object to provide both an electrical connector assembly and method of making same which obviate the need for relatively complicated (and often costly) mold assemblies and steps.

As defined in greater detail hereinbelow, it is a particular object of this invention to provide such an elastomeric pressure exertion member that will in turn accommodate higher buckling loads with greater compliancy than a similarly sized, dual layered, integral structure of the same elastomeric material throughout.

In one aspect of the invention, there is provided an electrical connector assembly comprising a first circuit member including a plurality of electrical conductors, a second circuit member also including a plurality of electrical conductors, a pressure exertion member for exerting a predetermined pressure against the second circuit member to electrically contact a respective one of the electrical conductors of the first circuit member, the pressure exertion member having a bilayered configuration including a first layer of relatively low durometer material and a second, separate layer adjacent the first layer, the second layer including a plurality of upstanding projections located in a pre-established pattern with selected ones of the upstanding projections adapted for aligning with respective ones of the electrical conductors of the second circuit member and for engaging the second circuit member to exert the predetermined pressure thereagainst, the upstanding projections of the second layer being of a higher durometer material than the first layer. The invention further includes means for retaining the pressure exertion member against the second circuit member to cause the exertion member to exert the pressure against the second circuit member.

In another aspect of the invention, there is provided a method of making an electrical connector assembly which comprises the steps of providing a first circuit member including a plurality of electrical conductors, providing a second circuit member including a plurality of electrical conductors, providing a pressure exertion member for exerting a predetermined pressure against the second circuit member to cause selected ones of the conductors of the second circuit member to form electrical connections with respective ones of the electrical conductors of the first circuit member, the pressure exertion member having a bilayered configuration including a first layer of relatively low durometer material and a second, different layer adjacent the first layer, the second layer including a plurality of upstanding projections located in a pre-established pattern, selected ones of the upstanding projections adapted for aligning with respective ones of the electrical conductors of the second circuit member for engaging the second circuit member to exert the predetermined pressure thereagainst. The upstanding projections of the second layer are of a higher durometer material than the first layer. This method further includes the step of providing means for retaining the pressure exertion member against the second circuit member to cause the exertion member to exert the pressure against the second circuit member.

According to another aspect of the invention, there is provided an information handling system including a computer structure having software and hardware as part thereof. The hardware of this system comprises at least one electrical connector assembly comprising a first circuit member including a plurality of electrical conductors, a second circuit member including a plurality of electrical conductors, and a pressure exertion member for exerting a predetermined pressure against the second circuit member to cause selected ones of the conductors of the second circuit member to each electrically contact a respective one of the electrical conductors of the first circuit member. The pressure exertion member has a bilayered configuration including a first layer of relatively low durometer material and a second, separate layer adjacent the first layer, the second layer including a plurality of upstanding projections located in a pre-established pattern, selected ones of the upstanding projections adapted for aligning with respective ones of the electrical conductors of the second circuit member and for engaging the second circuit member to exert the predetermined pressure thereagainst. The upstanding projections of the second layer are of a higher durometer material than the first layer. The system further includes and means for retaining the pressure exertion member against the second circuit member to cause the pressure exertion member to exert the predetermined pressure against the second circuit member.

According to yet another aspect of the invention, there is provided an elastomeric member adapted for exerting pressure against an electrically conductive member. This elastomeric member comprises a first layer of substantially solid, relatively low durometer elastomeric material having a first thickness, and a second, separate layer of a relatively higher durometer elastomeric material than the relatively low durometer elastomeric material of the first layer and having a second thickness, the second layer comprising a plurality of upstanding projections positioned directly onto the first layer.

BEST MODE FOR CARRYING OUT THE INVENTION

For a better understanding of the present invention, together with other and further objects, advantages and capabilities thereof, reference is made to the following disclosure in connection with the above-described drawings.

Figure 1:
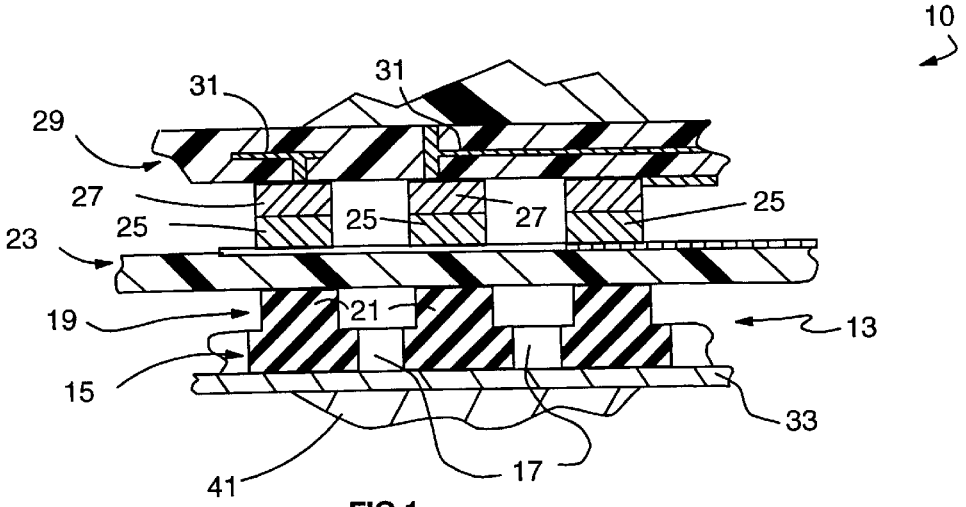
FIG.1 (PRIOR ART)
FIG. 1 is a partial, much enlarged side elevational view, in section, illustrating a known electrical connector assembly including a bilayered elastomeric pressure exertion member as part thereof.

In FIG. 1, there is shown a known electrical connector assembly 10, such as that defined in U.S. Pat. No. 5,059,129 (see FIG. 3). As defined therein, assembly 10 includes a bilayered elastomeric structure 13 including a lower, first layer 15 having a plurality of spaced apertures 17 therein. The elastomeric member further includes an integral top layer 19 comprised of a series of upstanding projections 21 which are strategically located relative (e.g., adjacent) to the corresponding apertures 17 in the lower first layer 15. Significantly, this elastomeric structure is comprised of a singular, substantially solid elastomeric material (e.g., silicone rubber) throughout. As further defined in U.S. Pat. No. 5,059,129, the elastomeric member 13 is adapted for exerting pressure against a circuitized substrate 23 (e.g., a flexible circuit having conductive members 25 thereon) to force the substrate's conductors (members 25) against corresponding conductors 27 of a second circuitized substrate 29 (e.g., a printed circuit board having internal conductive layers 31 as part thereof). Flexible circuits and printed circuit boards are well known in the art and further description of these members is not believed necessary. In FIG. 1, the elastomeric may be positioned on a supporting base structure 33 or such a support member may form part of the complete elastomeric structure (e.g., positioned therein), such that this structure may then be positioned on yet another support or base member 41.

Figure 2:
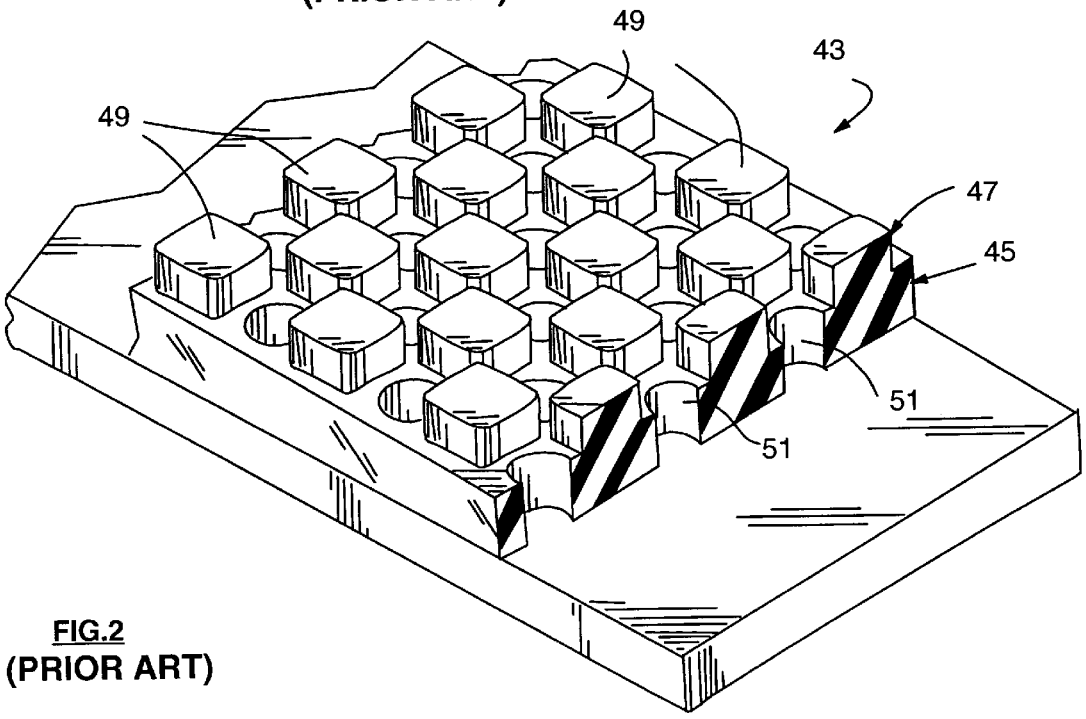
FIG.2 (PRIOR ART)
FIG. 2 is a much enlarged perspective view, partly in section, of a known alternative elastomeric pressure exertion member which may be utilized as part of an electrical connector assembly to couple two circuitized substrates.
Figure 5:
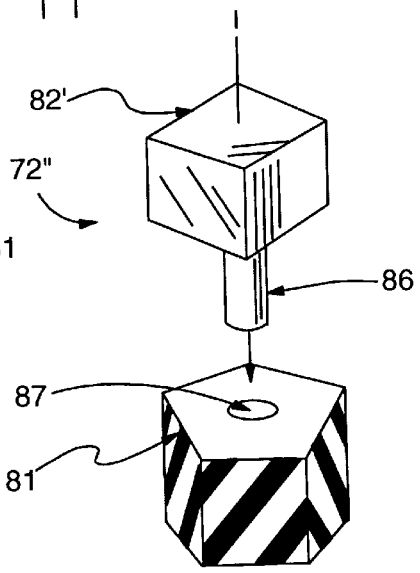
FIG. 5 is a partial perspective view, partly in section and much enlarged, of an alternative embodiment of an upstanding projection for use as part of the pressure exertion member of the invention.

In FIG. 2, there is shown yet another known embodiment of a bilayered elastomeric member 43, one example of this structure being defined in U.S. Pat. No. 5,099,393(see FIG. 10). This elastomeric structure 43, like that in FIG. 1, includes first and second layers 45 and 47 respectively, which, as seen and described in this patent, are formed as an integral structure of the same elastomeric material (e.g., silicone rubber). Structure 43, as shown, includes a plurality of integral upstanding projections 49 which form part of the top layer 47 and which are of substantially boxlike (e.g., rectangular cross-section) projections which, like the projections 21 in FIG. 1, designed for engaging a circuitized substrate to form an electrical connection similar to that in FIG. 1. The embodiment as depicted in FIG. 2 is also shown in FIG. 5 of the aforementioned U.S. Pat. No. 5,059,129. Structure 43, like that in FIG. 1, includes a plurality of apertures 51 oriented in a specific pattern relative to (e.g., adjacent) corresponding ones of the upstanding projections 49.

In summary, both of the elastomeric structures as defined above and in the three aforementioned U.S. patents, utilize a layered elastomeric structure wherein the individual layers are molded from the same elastomeric material to thus form an integral construction as evidenced by the cross-sectional view in these patents. While these structures have proven to provide very acceptable exertion forces to form an electrical connection of the type defined herein, such structures have heretofore required the use of relatively complex molding apparatus and processes. Accordingly, the present invention defines an electrical connector assembly including an elastomeric structure which may be formed utilizing less complex mold structures and processing. As defined herein, the unique structure formed by the method taught herein also provides buckling improvement through the elimination of apertures such as described in the foregoing patents within the base layer. This improvement will substantially prevent displacement of elastomeric material into such openings.

Figure 3:
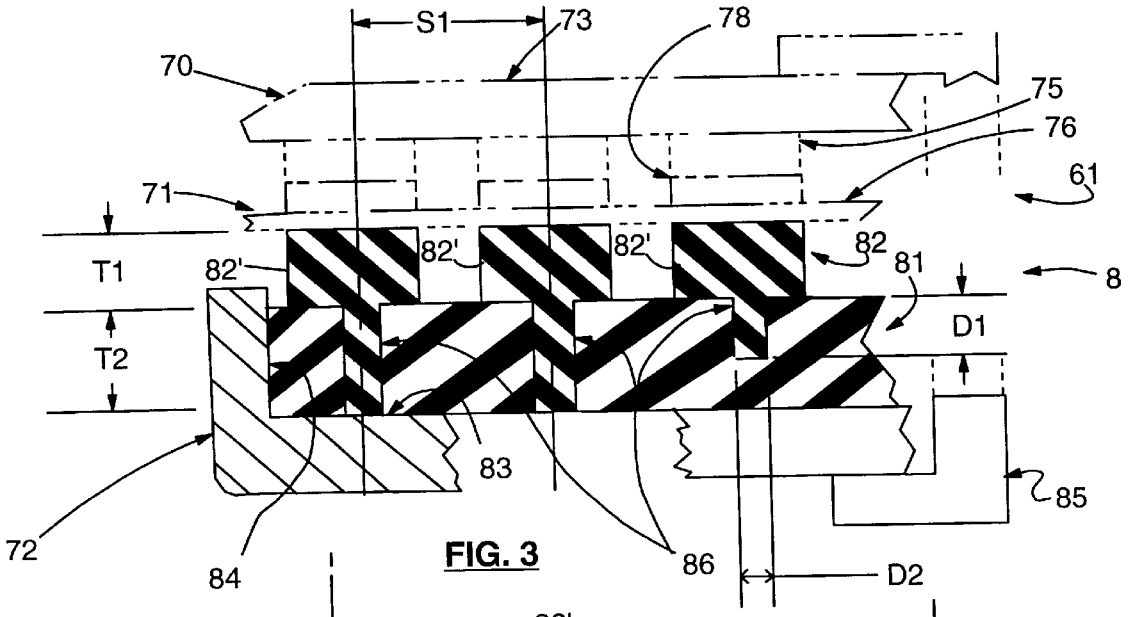
FIG. 3 is a partial, side elevational view, in section and much enlarged, of an electrical connector assembly according to one embodiment of the invention, showing the invention's two circuitized substrates and retaining means in phantom.

In FIG. 3, there is shown an electrical connector assembly 61 in accordance with the teachings of the present invention. Connector assembly 61 comprises a first circuit member 70 (phantom), a second circuit member 71 (also phantom), and a pressure exertion member 72. The first circuit member 70 is comprised of a dielectric material 73 (phantom), and a circuit pattern including a plurality of conducting pads 75 (e.g., copper pads and/or lines). One particular example of member 70 is a typical printed circuit board. Second circuit member 71 (phantom) is also comprised of a dielectric material 76 (phantom) and a circuit pattern of a plurality of conducting pads 78 (phantom). One particular example is a flexible circuit. The dielectric materials (73 and 76) of the first and second circuit members (70 and 71), respectively, may be polyimide (if a flexible circuit), an epoxy-based material known for use in printed wiring boards (referred to as "FR4" in the industry) or a ceramic material. "FR4" is a fiberglass-reinforced hardened epoxy resin material. Typical conductor pads/lines are copper or copper alloy and may be applied by one of several processes known in the art (two examples being additive and subtractive plating).

In a preferred embodiment of connector 61, first circuit member 70 is an "FR4" printed circuit board having thin (e.g., in the range of 0.0007 to 0.0014 inch thick) copper circuit lines and conducting pads 75. The lines and pads are preferably formed at the same time and then plated with a strike layer of nickel (approximately in the range of 50 to 100 micro-inches thick) then a strike layer of gold having a thickness in the range of about 30 to 50 micro-inches thick. (Both strike layers are not shown in FIG. 3.) Second circuit member 71 is a polyimide based flexible circuit having a dielectric thickness in the range of only about 0.001 to 0.005 inch with copper circuit lines and pads 78 having an overall thickness of from only about 0.0007 inch to 0.0014 inch thick, including nickel and gold layers of similar thickness to those defined immediately hereinabove. Additional copper may be added at the contact pad areas to elevate the final contact surface above any surface treatment (e.g., solder mask, coverlay, etc.), as known in the art of printed circuit and flexible circuit manufacture. Printed circuit boards and flexible circuits are very well known in the art and further description is deemed unnecessary.

Pressure exertion member 72 is comprised of a bilayered elastomer 80 including a first layer 81 of elastomer of relatively low durometer and thickness (T2), and a second, separate layer 82 including a plurality of upstanding projections 82' of a height (T1) arranged in a pre-established pattern so as to most effectively apply pressure to the pattern of spaced conducting pads 78 of second circuit member 71 through the thin dielectric layer 76. The upstanding projections 82' of second layer 82 are shown spaced apart at center-to-center distances (S1). It is understood that this spacing may be different than S1 in a different direction (e.g., toward the viewer). The second layer 82 of upstanding elastomeric projections 82' has a higher durometer than first layer 81. In one embodiment, projections 82' include extension portions 86 of a width (or diameter) D2 that projects into the first layer a predetermined distance D1. Pressure exertion member 72 also includes a base member 83 to which the first layer 81 of elastomer 80 is affixed, including in a constrained manner as shown (where a side wall 84 of base member 83 prevents lateral deflection of layer 81) when compressed against the second circuitized member.

A retainer 85 is provided to maintain elastomer member 80 and circuit members 70 and 71 in a compressed state, to thereby assure a predetermined pressure is exerted against the mating conducting pads of both circuit members. Retainer 85 may be a C-shaped clamp (as shown) or other adjustable structure capable of providing such compression.

Figure 4:
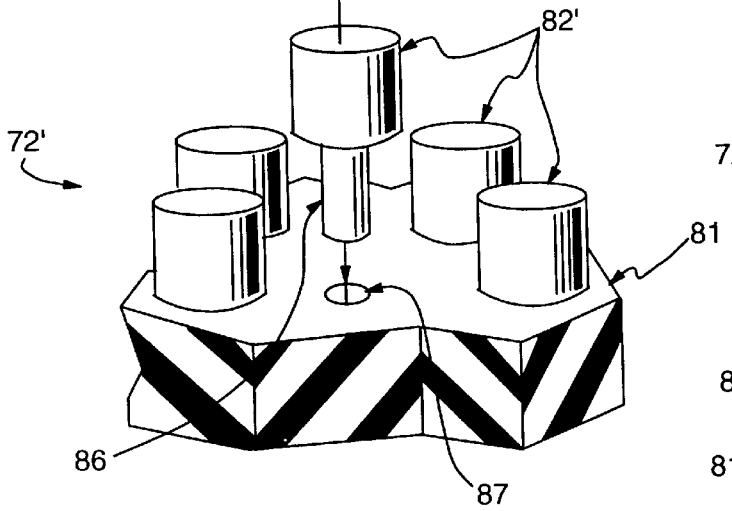
FIG. 4 is a partial perspective view, partly in section and much enlarged, of one embodiment of a pressure exertion member for use in the present invention.

FIGS. 4 and 5 show two embodiments of pressure exertion members 72' and 72" for use in the invention, one version (72') including cylindrical (FIG. 4) and the other (72") boxlike (FIG. 5) upstanding projections 82'. Alternatively, a substantially solid prismatic shape (not shown) can be used for projections 82'. In both examples, the first layer 81 of relatively low durometer elastomer includes a pattern of small diameter, spaced openings 87 therein. First layer 81 may be molded to the illustrated final shape (with openings 87 therein) or may be cut from sheet stock material where the openings are formed (e.g., drilled). The upstanding projections 82', as stated, are molded of a higher durometer elastomer than first layer 81 and then inserted into the openings of the first layer. In one embodiment, the elastomer in first layer 81 may be in the 20 to 50 Shore A durometer range while the second layer 82 may be in the 40 to 80 Shore A durometer range. In both examples, projections 82' are of higher durometer than the underlying, base-type first layer 81.

Figure 4A:
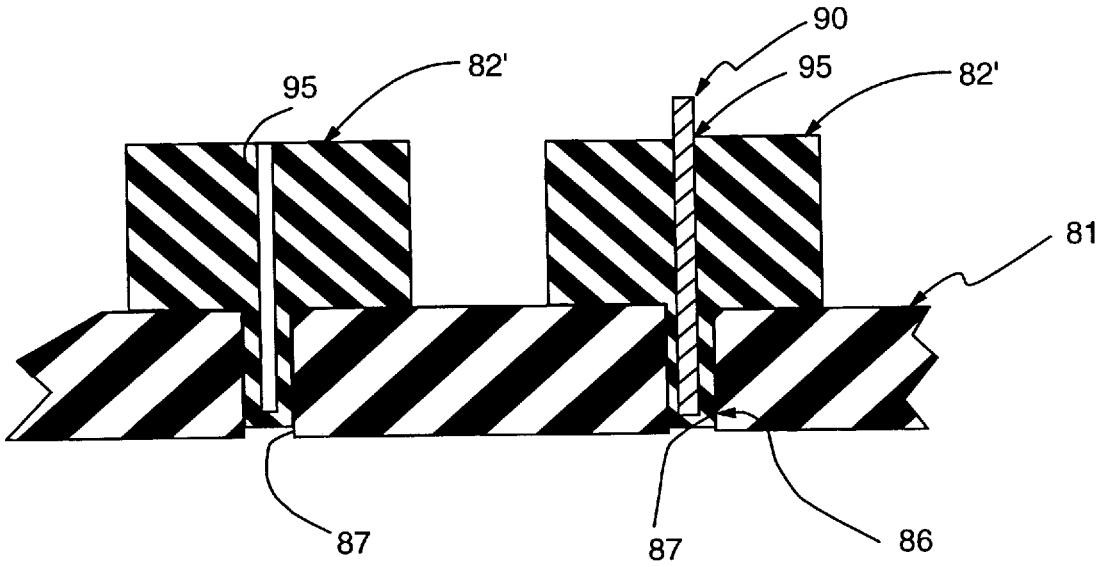
FIGS. 4A and 4B are partial sectional views, much enlarged, of two alternative embodiments of pressure exertion members for use in the present invention.
Figure 4B:
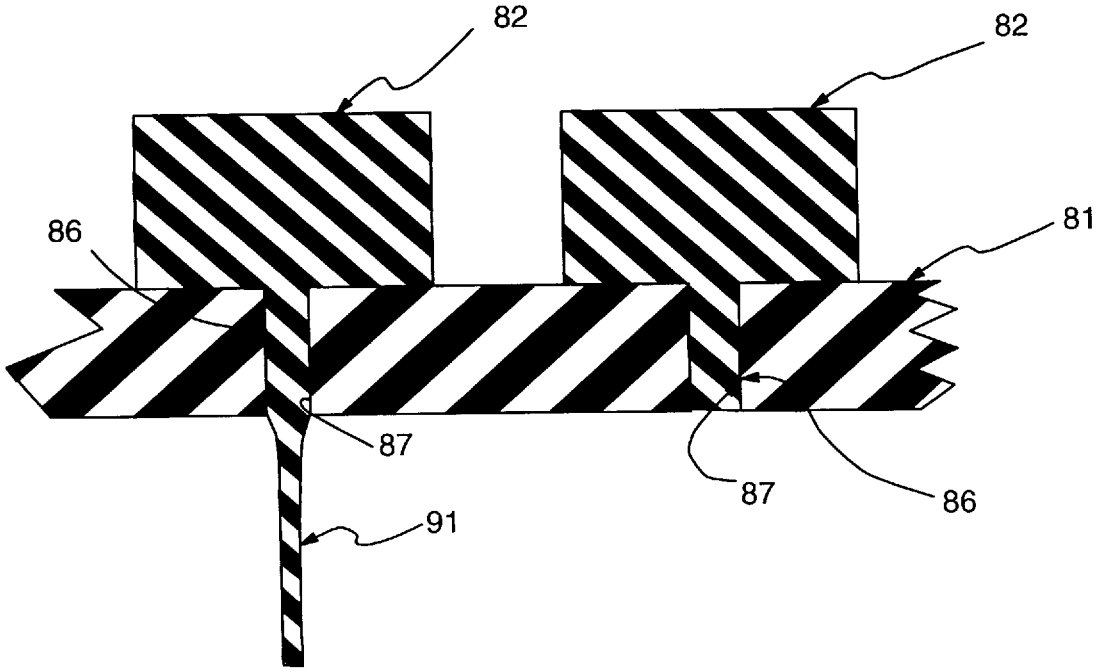

FIGS. 4A and 4B show two means of assembling upstanding projections 82' into first layer 81 of the bilayered elastomeric structure. In FIG. 4A, upstanding projections 82' and extension portions 86 have been formed with a closed-ended, cylindrical shaped cavity 95 along the center line of the upstanding projection. A pin (90) is inserted into this cavity (95) and extension 86 then positioned within aperture 87 of layer 81. In FIG. 4B, one upstanding projection 82' and its extension portion 86 have been molded with a tail portion 91 which freely fits through aperture 87. Tail portion 91 is positioned through aperture 87 and then used to pull the tip 91 of extension 86 further into aperture 87 so that the larger portion of extension 86 is firmly seated in aperture 87 (as seen in the left example in FIG. 4B). After upstanding projection 82' is positioned relative to first layer (81), the tail may be severed (e.g., as shown in right example of FIG. 4B).

In one embodiment of the invention, silicone rubber may be used for each of the individual, separate layers 81 and 82, while base member 83 is preferably metal (e.g., stainless steel). In this embodiment, the following are representative examples of the range of values for the provided dimensions in FIG. 3:

S1—0.025 to 0.075 inch
D1—0.015 to 0.020 inch
D2—0.003 to 0.007 inch
T1—0.020 to 0.050 inch
T2—0.020 to 0.050 inch These dimensional comparisons are not meant to limit the invention, however, as variations thereto may still assure satisfactory exertion forces as required in today's electronic packaging structures.

Figure 6:
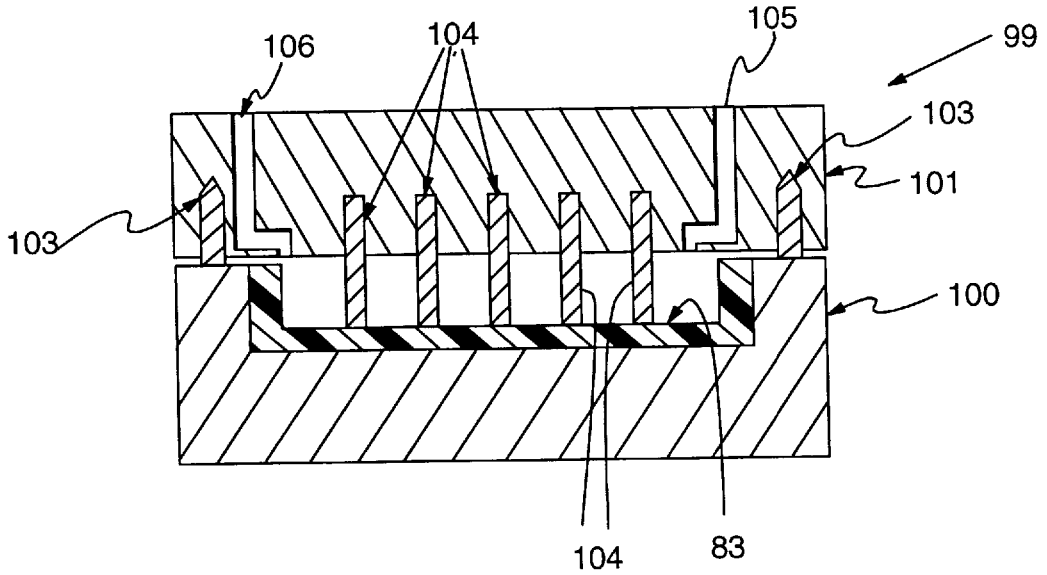
FIGS. 6–11 illustrate preferred embodiments of the method steps and apparatus which may be used to make the double-layered elastomeric member which forms the pressure exertion member of the invention.
Figure 7:
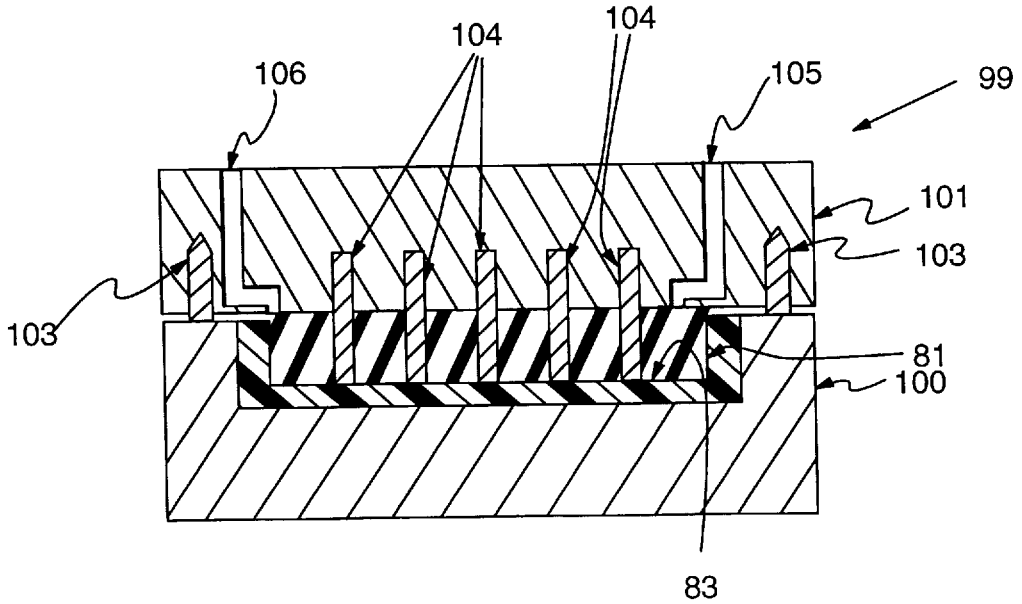
Figure 8:
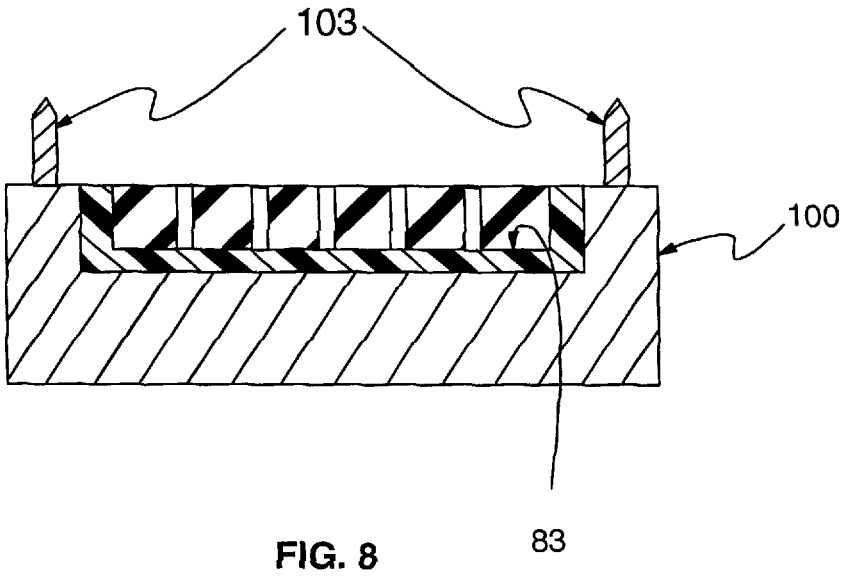
Figure 9:
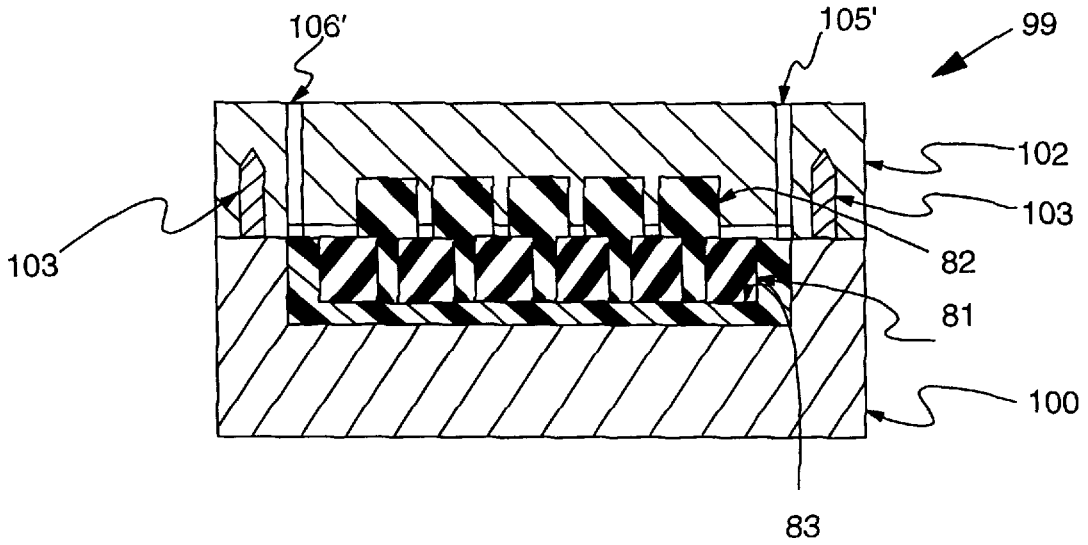
Figure 10:
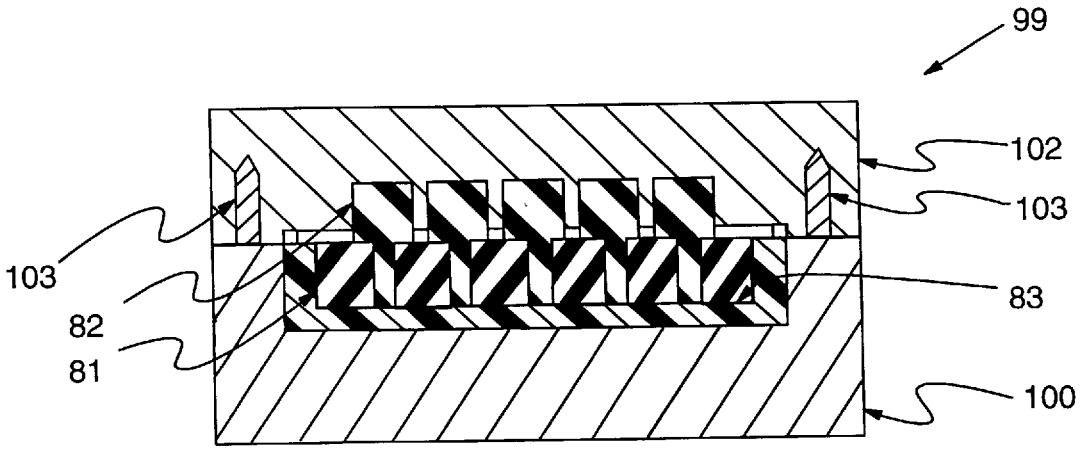
Figure 11:
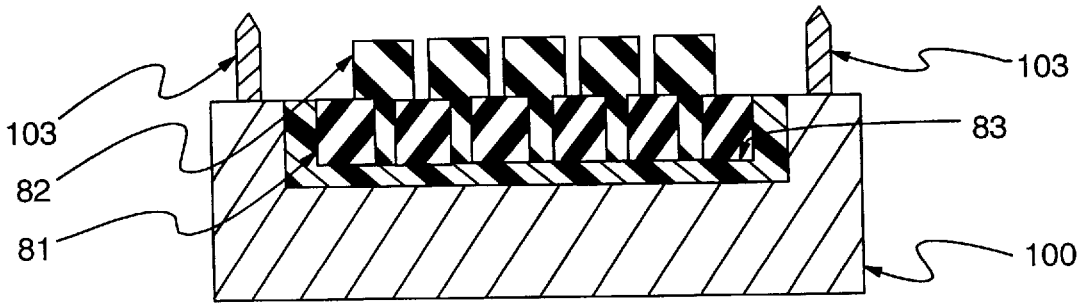

A preferred method of forming pressure exertion member 72 is by molding the individual layers 81 and 82 of elastomer onto base 83 in sequential steps. This process is defined in greater detail hereinbelow with the description of FIGS. 6–11. FIGS. 6–11 show a mold apparatus 99 comprising a base section 100, a first top section 101 (FIGS. 6,7), and a second top section 102 (FIGS. 9 and 10). Apparatus 99 is used in what can be referred to as a transfer molding operation in which base 83 is positioned in the mold's base section 100. The first top mold 101 is then aligned to the base section 100, typically by alignment pins 103 (FIG. 6). The first top section includes core pins 104 to create openings in the first layer 81 of elastomer which will eventually receive the formed extensions 86 of layer 82. These core pins 104 can be omitted if the second layer is adhered directly to the first layer during the molding operation or if an adhesive is used to bond the two layers. The mold apparatus 99 is then positioned in a typical molding press (not shown) and the elastomer for the first layer (81) injected into the mold through one or more sprues 105. The mold is vented (106) to provide for escaping gases. After this first elastomer transfer (injection) and suitable curing or elastomer cross-linking of layer 81 has occurred, this first layer is now formed (FIG. 7). The first top section 101 is then removed, along with any residue elastomer material remaining in the sprue or vent openings. The resulting structure at this stage is seen in FIG. 8. Second mold top section 102 is then aligned and assembled to the mold's base section 100. Then, a second elastomer material is transferred (injected) through sprue 105', with vent 106' providing gas escape. FIG. 9 illustrates these elements. FIG. 10 shows a cross-section offset from the sprue and vent. Passageways in the second top section 102 provide for the fluidized elastomer to flow and fill to form the complete second layer 82, including the extension portions 86. The second top section 102 is then removed (FIG. 11) and the completed, double-layered elastomeric structure ejected from the common base section 100.

Molding the upstanding projections 82' of the second layer 82 with extension 86 from an electrically conductive elastomer can also provide an alternate electrical path for the final assembly (to connect selected conductors 78 to ground (e.g., metal base 83) if desired. Making the length extension D1 equal to the thickness T2 of first layer 81 allows the upstanding projections to make electrical contact with base member 83. Alternatively, an anisotropic conductive elastomer can be used as the first layer material to provide one or more electrical paths. As stated, these electrical paths can be used to provide ground connections for static charge, circuit grounds, or signal conductors of the finally assembled structure.

By way of specific example, a pressure member having the following dimensions and of the materials described above may be formed. An upstanding projection spacing, S1, of about 0.050 inch is used, aligned in a rectangular grid. A first layer thickness, T2, of 0.035 inch, a corresponding second layer height, T1, of 0.035 inch (with an extension length, D1, of 0.0175 inch), cylindrically shaped upstanding projections having a diameter of about 0.038 inch and a projection distance, D2 of about 0.005 inch assures effective pressure exertion. The first layer 81 includes a 50 Shore A durometer and the second layer 82 a 70 Shore A durometer, and are both of silicone rubber. A preferred elastomer is Dow Corning's Silatic LCS (a silicone elastomer), several examples of materials forming this series of acceptable elastomers. In these examples, layers 81 and 82 possessed similar spring rates, an important aspect or this invention. The Dow Corning Silatic LCS-745 elastomer is preferably mixed with one part per hundred of a suitable cross-linking agent for adding strength and stress relaxation properties in the final compound. One example of such a cross-linking agent is Varox DPBH-50, available from the R. T. Vanderbilt Company. (Silatic is a trademark of Dow Corning and Varox is a trademark of the R. T. Vanderbilt Company). This compound is now used for the defined molding steps. In one example, a first mold period of from about 5 to 20 minutes is preferably used, at a temperature of about 150 degrees Celsius C to about 200 degrees C. In one particular example, a first mold period of about 10 minutes at a temperature of 175 degrees C is used. After the molding of first layer 81, the second mold top is positioned and the Silatic LCS-747 elastomer that has been similarly mixed with a cross-linking agent is transferred (FIG. 9) using similar molding parameters as in the first step.

During molding, the elastomeric materials bond to respective mating surfaces which may be pretreated with an adhesion promoter to enhance this interface, if desired. The first layer 81 is bonded to base member 83 by vulcanization of the elastomer to the metal base member. Similarly, the second layer is bonded to the first layer. Depending on the desired use of the resulting elastomer structure and the bond strength between the first and second layers, the extensions 86 may not be required to assist in retaining the second layer within (and atop) the underlying first layer.

Following this molding, final curing of the elastomeric material occurs over a specified time period and temperature. In one example, this time period may range from two to about six hours at a temperature of from about 175 degrees C to 225 degrees C. In a specific example, this cure may occur within four hours at a temperature of about 205 degrees C.

Compression of the pressure exertion member of the invention by application of a prescribed force or displacement causes deformation (compression) of both the first and second layers. The ratio of second layer 82 deformation (change in dimension T1) to first layer 81 deformation (change in dimension T2) is indicative of the relative contribution of each layer to the overall pressure exertion member. Ideally, this ratio is approximately equal to a range of from 0.5:1.0 to 2:1.0. In a specific example, the ratio is 1.95:1.0. A ratio of one results when the spring rates of the first and second layers are equal. When the spring rates are equal, the overall spring rate is a minimum and the largest compliance is obtained. As stated above, the spring rates for both layers are preferably substantially similar.

One advantage of a bilayered elastomeric structure as taught is a resulting increased compliancy (or reduced spring rate) with a higher buckling load. A cylindrical structure of elastomer can typically have a height (or length) approximately about 1.2 times the cylindrical diameter without experiencing lateral buckling when compressed along the cylindrical axis. As electronic packages become more densely filled, the space available for exerting pressure on a given circuit member is reduced. As the space available is reduced, so is the length of cylinder that can be compressed without lateral buckling. This reduction in cylinder length also decreases the compression of the elastomer since the allowable elastomer compression is typically a percentage of the cylinder length, which for stress relaxation purposes is within the range of approximately 20 to 30% of the cylinder's original length. When the first layer of elastomer is a sheet of elastomer, the sidewall 84 of base 83 provides constraint to the first layer to maintain the alignment of upstanding projections of the second layer 82 with the conductive pads 78 of the second circuitized member 71.

While there have been shown and described what are at present the preferred embodiment of the invention, it will be obvious to those skille changes and modifications may be made therein without departing from the scope of the invention as described by the appended claims.

What is claimed is:

1. An electrical connector assembly comprising:

a first circuit member including a plurality of electrical conductors;

a second circuit member including a plurality of electrical conductors;

a pressure exertion member for exerting a predetermined pressure against said second circuit member to cause selected ones of said conductors of said second circuit member to electrically contact a respective one of said electrical conductors of said first circuit member, said pressure exertion member having a bilayered configuration including a first layer of relatively low durometer hardness material and a second, separate layer adjacent said first layer, said second layer including a plurality of upstanding projections located in a pre-established pattern, selected ones of said upstanding projections adapted for aligning with respective ones of said electrical conductors of said second circuit member and for engaging said second circuit member to exert said predetermined pressure thereagainst, said upstanding projections of said second layer being of a non conductive material having higher durometer hardness than said first layer; and means for retaining said pressure exertion member against said second circuit member to cause said exertion member to exert said pressure against said second circuit member.

2. The electrical connector assembly according to claim 1 wherein said first circuit member comprises a printed circuit board.

3. The electrical connector assembly according to claim 1 wherein said second circuit member comprises a flexible circuit.

4. The electrical connector assembly according to claim 3 wherein said flexible circuit includes a polyimide dielectric material having said electrical conductors positioned thereon.

5. The electrical connector assembly according to claim 3 wherein said flexible circuit includes a glass-reinforced epoxy dielectric material having said electrical conductors positioned thereon.

6. The electrical connector assembly according to claim 1 wherein said first layer of said bilayered pressure exertion member has a hardness within the range of about 20 to about 50 Shore A.

7. The electrical connector assembly according to claim 6 wherein said second separate layer of said bilayered pressure exertion member has a hardness within the range of about 40 to about 80 Shore A.

8. The electrical connector assembly according to claim 6 wherein said first layer of said pressure exertion member is comprised of silicone rubber.

9. The electrical connector assembly according to claim 7 wherein said second separate layer of said pressure exertion member is comprised of silicone rubber.

10. The electrical connector assembly according to claim 1 wherein said first layer of said pressure exertion member comprises an essentially solid layer of material having a substantially uniform thickness thereacross.

11. The electrical connector assembly according to claim 10 wherein said plurality of upstanding projections of said second separate layer are each of substantially cylindrical configuration.

12. The electrical connector assembly according to claim 10 wherein said plurality of upstanding projections of said second separate layer are each of a substantially boxlike configuration.

13. The electrical connector assembly according to claim 1 wherein portions of said upstanding projections of said second separate layer of said pressure exertion member substantially extend into regions of said first layer of said pressure exertion member.

14. The electrical connector assembly according to claim 13 wherein said first layer includes a plurality of openings spacedly positioned therein and said plurality of upstanding projections of said second separate layer each include an extension portion adapted for being positioned within a respective one of said openings within said first layer.

15. The electrical connector assembly according to claim 1 wherein said means for retaining said pressure exertion member against said second circuit member comprises a clamp.

16. The electrical connector assembly according to claim 1 further including a base member for substantially supporting said first layer of said pressure exertion member.

17. The electrical connector assembly according to claim 16 wherein said first layer of said pressure exertion member is positioned within said base member, said base member substantially preventing expansion of said first layer in a second direction substantially perpendicular to the force applied on said first layer by said second separate layer when said pressure exertion member exerts a predetermined pressure against said second circuit member.

18. The electrical connector assembly according to claim 1 wherein said upstanding projections of said second separate layer are electrically conductive.

19. The electrical connector assembly according to claim 18 wherein the material of said upstanding projections is an electrically conductive elastomer.

20. A method of making an electrical connector assembly comprising:

providing a first circuit member including a plurality of electrical conductors;

providing a second circuit member including a plurality of electrical conductors;

providing a pressure exertion member for exerting a predetermined pressure against said second circuit member to cause selected ones of said electrical conductors of said second circuit member to form electrical connections with respective ones of said electrical conductors of said first circuit member, said pressure exertion member having a bilayered configuration including a first layer of relatively low durometer hardness material and a second, separate layer adjacent said first layer, said second layer including a plurality of upstanding projections located in a pre-established pattern, selected ones of said upstanding projections aligning with respective ones of said electrical conductors of said second circuit member and for engaging said second circuit member to exert said predetermined pressure thereagainst, said upstanding projections of said second layer being of a non conductive material having higher durometer hardness than said first layer; and providing a means for retaining said pressure exertion member against said second circuit member to cause said pressure exertion member to exert said pressure against said second circuit member.

21. The method according to claim 20 further comprising the steps of:

providing a base member including a cavity therein;

molding said first layer of said pressure exertion member of said relatively low durometer material within said cavity of said base member; and molding said second, separate layer of said pressure exertion member of said relatively high durometer material onto said first layer of said pressure exertion member.

22. The method according to claim 20 further including the steps of providing a plurality of spaced-apart openings within said first layer and further providing at least one extension portion on selected ones of said upstanding projections of said second separate layer, said extension portions of said upstanding projections thereafter positioned within respective ones of said spaced-apart openings.

23. The method according to claim 22 further including the steps of providing a base member including a cavity therein, molding said first layer of said pressure exertion member having said openings therein within said base member and thereafter molding selected ones of said upstanding projections of said second layer to each include said at least one extension portion thereon onto said first layer such that said extension portions are positioned within said respective ones of said spaced-apart openings.

24. In an information handling system including a computer structure having hardware and software, the improvement wherein said hardware includes at least one electrical connector assembly comprising a first circuit member including a plurality of electrical conductors, a second circuit member including a plurality of electrical conductors, and a pressure exertion member for exerting a predetermined pressure against said second circuit member to cause selected ones of said conductors of said second circuit member to each electrically contact a respective one of said electrical conductors of said first circuit member, said pressure exertion member having a bilayered configuration including a first layer of relatively low durometer hardness material and a second, separate layer adjacent said first layer, said second layer including a plurality of upstanding projections located in a pre-established pattern, selected ones of said upstanding projections adapted for aligning with respective ones of said electrical conductors of said second circuit member and for engaging said second circuit member to exert said predetermined pressure thereagainst, said upstanding projections of said second layer being of a non conductive material having higher durometer hardness than said first layer, and means for retaining said pressure exertion member against said second circuit member to cause said pressure exertion member to exert said predetermined pressure against said second circuit member.

25. An elastomeric member adapted for exerting pressure against an electrically conductive member, said elastomeric member comprising:

a first layer of substantially solid, relatively low durometer hardness elastomeric material having a first thickness; and a second, separate layer of a relatively higher durometer hardness elastomeric material than said relatively low durometer elastomeric material of said first layer and having a second thickness, said second layer comprising a plurality of upstanding projections positioned directly onto said first layer.

26. The elastomeric member according to claim 25 wherein said first and second layers possess similar spring rates.

27. The elastomeric member according to claim 25 wherein both of said first and second layers of elastomeric material are comprised of silicone rubber.

28. The elastomeric member according to claim 25 wherein selected ones of said upstanding projections of said second separate layer are of a substantially cylindrical shape.

29. The elastomeric member according to claim 25 wherein selected ones of said upstanding projections of said second separate layer are of a substantially boxlike shape.

30. The elastomeric member of claim 25 wherein said first layer of elastomeric material includes a plurality of openings spacedly located therein and selected ones of said upstanding projections include an extension portion, said extension portion being positioned within respective ones of said openings.

* * * * *